United States Patent [19]

Asano et al.

[11] Patent Number: 4,915,527

[45] Date of Patent: Apr. 10, 1990

[54] CASE FOR STICK-TYPE COSMETIC

[75] Inventors: Shinichi Asano; Tomio Tahara, both of Tokyo, Japan

[73] Assignee: Kamaya Kagaku Kogyo Co., Ltd., Tokyo, Japan

[21] Appl. No.: 223,280

[22] Filed: Jul. 22, 1988

[30] Foreign Application Priority Data

Apr. 22, 1988 [JP] Japan ..... 63-54145[U]

[51] Int. Cl.[4] ..... A45D 40/00; A45D 40/02; A45D 40/12; A45D 40/22

[52] U.S. Cl. ..... 401/60; 401/108

[58] Field of Search ..... 401/59–61, 401/98, 107, 108, 117, 262, 202; 132/318

[56] References Cited

U.S. PATENT DOCUMENTS

| | | | |
|---|---|---|---|
| 1,734,117 | 11/1929 | Coryell | 401/60 |
| 2,010,185 | 8/1935 | Garreau | 401/60 |
| 2,540,304 | 2/1951 | Thomsen | 401/60 |
| 2,617,522 | 11/1952 | Coe | 401/59 |
| 4,518,273 | 5/1985 | Larizza | 401/202 X |

FOREIGN PATENT DOCUMENTS

| | | | |
|---|---|---|---|
| 924786 | 8/1947 | France | 401/60 |

*Primary Examiner*—Richard J. Apley
*Assistant Examiner*—David J. Bender
*Attorney, Agent, or Firm*—Hoffmann & Baron

[57] ABSTRACT

A case for a stick-type cosmetic, which includes: a tubular case body having an open end, the body having parallel planar opposite side faces constituting a part of the outer peripheral face thereof, each of the side faces having a through slot; a receptacle for receiving the proximal end of the cosmetic, the receptacle being slidably received in the tubular body; a pair of coaxial pivots connected to the receptacle, the pivots being slidably received respectively in the through slots; and a lid including a head portion and a pair of spaced parallel leg portions, each of the leg portions having outer and inner opposite faces, the leg portions being pivotally connected to the receptacle through the pivots, the lid being movable to a closed position. When the lid is in the closed position, the head portion of the lid closes the open end of the body, and the entire inner faces of the leg portions are mated respectively with the entire side faces of the body. The outer peripheral face of the body includes a pair of curved faces, each extending between the side faces of the body. The outer faces of the leg portions are smoothly continuous to the curved faces of the body when the lid is in its closed position.

11 Claims, 4 Drawing Sheets

CASE FOR STICK-TYPE COSMETIC

BACKGROUND OF THE INVENTION

This invention relates to a case suitable for encasing a stick-type cosmetic such as a lipstick, a stick-type rouge, a stick-type lip cream and the like in an extensible and retractable manner.

An example of the conventional case for a stick-type cosmetic is illustrated in FIGS. 1 to 3. This case includes a substantially square tubular body 1 having open and closed ends and opposite side walls 4 and 4 in which a pair of slots 5 and 5 are formed respectively. A receptacle 2, by which one of the ends of a stick-type cosmetic C is fixedly received, fits in the body 1 for sliding movement therealong. A pair of coaxial hollow pivots 3 (only one shown in FIG. 1) project respectively from opposite side faces of the receptacle 2, and slidably fit respectively in the slots 5 and 5 so that the sliding movement of the receptacle 2 is enabled. A generally U-shaped lid member 6 is connected to the body 1. This lid member 6 has a pair of spaced parallel leg portions 7 and 7 and a connecting portion 9 bridging the distance between the proximal ends of the leg portions 7 and 7. A pair of pins 7*a* and 7*a* (only one shown in FIG. 1) are formed respectively on distal free ends of the leg portions 7 and 7, and project toward each other in coaxial relationship The pins 7*a* and 7*a* rotatably fit respectively in the hollow pivots 3 and 3 so that the lid member 6 is pivotally movable about the axes of the hollow pivots 3. Movement of the lid member 6 causes the receptacle 2 to be moved within and along the tubular body 1 between its retracted most position and its extended most position. When the receptacle 2 is in its retracted most position, the cosmetic C is fully retracted within the body 1, while, when the receptacle 2 is in its extended most position, the cosmetic C fully projects outward from the body 1.

First and second projecting members 5*a* and 5*b* are formed on the inner peripheral face of each of the slots 5 and 5. The first projecting member 5*a* is positioned adjacent to the open end of the body 1, while the second projecting member 5*b* is positioned adjacent to the closed end of the body 1. When the receptacle 2 is brought to its extended most position, the hollow pivots 3 and 3 resiliently engage respectively with the first projecting members 5*a* and 5*a*. On the other hand, when the receptacle 2 is brought to its retracted most position, the hollow pivots 3 and 3 resiliently engage respectively with the second projecting members 5*b* and 5*b*.

The lengths of the leg portions 7 and 7 are such that when the receptacle 2 is in its retracted most position, the lid member 6 is pivotally movable to its closed position as shown in FIG. 2, where the connecting portion 9 closes the open end of the body 1. A pair of engaging projections 8 and 8 are formed respectively on the end faces of the side walls 4 and 4, adjacent to the open end of the body 1. The engaging projections 8 and 8 are releasably engageable respectively with a pair of recesses (not shown) formed in the inner face of the connecting portion 9. These engaging projections 8 and 8 cooperate with the recesses of the connecting portion 9 to retain the lid member 6 in its closed position.

In use of the case described above, the lid member 6 is pivoted from its closed position approximately 180° to a position in which the inner face of the connecting portion 9 confronts the closed end face of the body 1. Needless to say, the recesses of the connecting portion 9 are disengaged respectively from the engaging projections 8 and 8 when the lid member 6 is pivoted. The lid member 6 is then, moved straightly along the slots 5 of the tubular body 1 until the hollow pivots 3 and 3 are brought into engagement respectively with the first projecting members 5*a* and 5*a*, and the inner face of the connecting portion 9 is brought into contact with the closed end face of the body 1. The cosmetic C is, thus, protruded outward from the open end of the body 1 as shown in FIG. 3. Alternatively, the lid member 6 may be pulled up from its closed position so that the inner face of the connecting portion 9 moves away from the open end of the body 1, and the hollow pivots 3 and 3 are disengaged respectively from the second projections 5*b* and 5*b*. Then, the lid member 6 is pivoted about 180° to a position in which the inner face of the connecting portion 9 confronts the closed end of the body 1. Subsequently, the lid member is moved straight along the slots 5 in the same manner as described above to fully project the cosmetic C out of the body 1. After the cosmetic C is used in conventional manner, it is retracted into the body 1 in the reverse manner to described above.

In the cosmetic case thus constructed, when the lid member 6 is in its closed position, the leg portions 7 and 7 project outward respectively from the outer faces of the opposite side walls 4 and 4 as shown in FIG. 3. In other words, the side edge faces of the leg portions 7 and 7 form steps on the outer faces of the respective side walls 4 and 4, causing the outer faces of the side walls 4 and 4 to be irregular as a whole and marring the appearance of the case. For this reason, there arises such a problem that when the case is carried in a pocketbook, the carrier's fingers or other articles in the pocketbook are likely to be caught by the leg portions 7 and 7, or external force tends to act upon the leg portions 7 and 7. This may result in that the recesses on the connecting portion 9 are accidentally disengaged from the engaging projections 8 and 8, and thereby the cosmetic C projects unintentionally out of the body 1.

SUMMARY OF THE INVENTION

Accordingly, it is an object of the present invention to provide a case for a stick-type cosmetic, in which an unintentional projection of the stick-type cosmetic is prevented.

With this and other objects in view, the present invention provides a cosmetic case which includes: a substantially tubular case body having an open end and a closed end, the body having parallel planar opposite side faces constituting a part of the outer peripheral face of the body, the planar side faces extending between the open and closed ends of the body, each of the planar side faces having a through slot extending along the longitudinal axis of the body; a receptacle member for fixedly receiving one o the opposite ends of a stick-type cosmetic such as lipstick, the receptacle member being slidably received in the tubular case body for axial movement between first and second positions; a pair of coaxial pivots connected to the receptacle member in such a manner that the axes of the pivots are perpendicular to the planar side faces of the body, the pivots being received respectively in the through slots of the body for sliding movement along the slots; and a generally U-shaped lid member having a head portion and a pair of spaced parallel leg portions, each of the leg portions having proximal and distal ends and outer and inner opposite faces, the proximal ends of the leg portions being integrally connected to the head portion, the distal ends of the leg portions being pivotally connected to the receptacle member through the pivots so that the lid member is pivotally movable about the axes of the pivots, the inner faces of the leg portions being substantially planar, the lid member being movable to a closed position, the closed position being such that when the lid member is in the closed position, the head portion of the lid member closes the open end of the body, and the entire inner faces of the leg portions are mated respectively with the entire planar side faces of the body. The outer peripheral face of the body includes a pair of front and rear curved faces, each extending between the planar side faces of the body. The front and rear curved faces are convexly curved when the curved faces are viewed from a plane perpendicular to the longitudinal axis of the body. The outer faces of the leg portions are convexly curved when the outer faces of the leg portions are viewed from a plane perpendicular to the longitudinal axes of the leg portions. The outer faces of the leg portions are smoothly continuous to the front and rear curved faces of the body when the lid member is in its closed position.

It is preferred that the outer faces of the leg portions cooperate with the front and rear curved faces of the body to form a substantially cylindrical outer peripheral face of the case when the lid member is in its closed position. The head portion of the lid member may be of a dome-like configuration having a semispherical outer face. It is also preferred that the semispherical outer face is smoothly continuous to the outer faces of the leg portions, and is smoothly continuous to the front and rear curved faces of the body when the lid member is in its closed position.

DETAILED DESCRIPTION OF THE PREFERRED EMBODIMENTS

Figure 1:
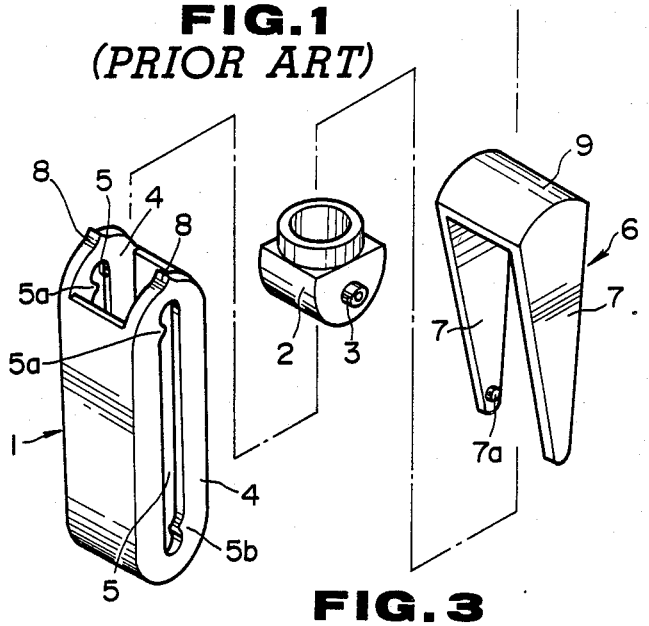
FIG. 1 (PRIOR ART)
FIG. 1 is an exploded perspective view of a conventional case for a stick-type cosmetic.
Figure 3:
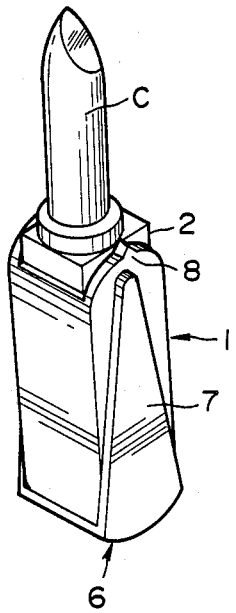
FIG. 3 (PRIOR ART)
FIG. 3 is a perspective view of the case in FIG. 1, showing the stick-type cosmetic projecting outward from a case body.
Figure 2:
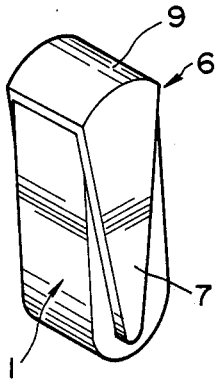
FIG. 2 (PRIOR ART)
FIG. 2 is a perspective view of the case in FIG. 1, showing a lid member in its closed position.

Referring now to FIGS. 4 to 14, wherein like reference characters designate corresponding parts throughout several views, and descriptions of the corresponding parts are omitted once given.

FIGS. 4 to 9 illustrate a cosmetic case according to the present invention, in which a stick-type cosmetic in the form of a lipstick C is contained. This case comprises three principal components, namely, a substantially tubular case body 10, a tubular receptacle 15 and a generally U-shaped lid member 16. The case body 10 has a inner face defining a internal space 11. The inner face of the case body 10 has a circular cross section. The internal space 11 opens to one of the opposite end faces, that is, the upper end face 10*a*, as viewed in FIG. 4, of the body 10. The lower end of the case body 10 is closed. A pair of guide grooves 10*b* and 10*b* are formed respectively in the opposed portions of the inner face of the case body 10, and extend along the longitudinal axis of the body 10. The outer peripheral face of the body 10 includes parallel planar opposite side faces 13 and 13. The planar side faces 13 and 13 extend between the open and closed ends of the body 10 so as to be parallel to the longitudinal axis of the body 10. A pair of through slots 14 (only one shown in FIG. 4), each extending parallel to the longitudinal axis of the body 10, are formed respectively in the planar side faces 13 and 13. Each of the slots 14 is defined by a inner peripheral wall composed of upper and lower end portions and a pair of opposed elongated side portions. A plurality of projecting members 14*a* are disposed on one of the opposed side portions of the inner peripheral wall at equal axial intervals. A pair of upper and lower semispherical projections 13*a* and 13*a* are formed on each of the planar faces 13 and 13, and are located on an imaginary line coincidental with the centerline of each slot 14. The upper projection 13*a* on each planar face 13 is located between the open end face 10*a* of the body 10 and the upper end portion of the corresponding inner peripheral wall, while the lower projection 13*a* on each planar face 13 is located between the closed end face of the body 10 and the lower end portion of the corresponding inner peripheral wall.

The receptacle 15 is of a cylindrical configuration, and has an open end and a closed end. In this receptacle 15, one of the opposite end portions of the stick-type cosmetic C is coaxially and fixedly received. The receptacle 15 has a pair of diametrically opposed bores 15*a* and 15*a* (only one shown in FIG. 4) formed in the outer peripheral face thereof. Furthermore, a pair of sliding projections 15*b* and 15*b* (only one shown in FIG. 4) are formed on that portions of the receptacle's outer face between the bores 15*a* and 15*a*. The receptacle 15 holding the cosmetic C, is coaxially received in the tubular body 10 in such a manner that the sliding projections 15*b* and 15*b* slidably fit respectively in the guide grooves 10*b* and 10*b* of the body 10.

The lid member 16 has a rounded head portion 16*a* and a pair of spaced parallel leg portions 17 and 17. Each leg portion 17 has proximal and distal ends. The leg portions 17 and 17 are integrally connected at their proximal end to the head portion 16*a*, and extend downward, as viewed in FIG. 4, from the had portion 16*a*. The head portion 16*a* is in the form of a dome having a semispherical outer face. Each of the leg portions 17 and 17 has outer and inner opposite faces. The outer face of each leg portion 17 is convexly curved when it is viewed from a plane perpendicular to the longitudinal axis of the leg portion, while the inner face of each leg portion 17 is substantially planar. A pair of guide grooves 17*b* and 17*b* (only one shown in FIG. 4) are formed respectively in the inner faces of the leg portions 17 and 17. Each guide groove 17*b* extends from the proximal end to the distal end of the corresponding leg portion 17. A pair of bores 17*a* and 17*a* are formed respectively in the distal end portions of the leg portions 17 and 17.

A pair of pivots 18*a* and 18*a* (only one shown in FIG. 4) pivotally interconnect the lid member 16 with the receptacle 15. Each of the pivots 18*a* is composed of a head and a hollow stem connected to and extending from the head. The pivots 18*a* and 18*a* are connected to both the lid member 16 and the receptacle 15 in the following manner. That is, the hollow stem of each pivot 18*a* is inserted, from the outer face of the corresponding leg portion 17, into the bore 17*a* of the same leg portion 17. The hollow stem of the pivot 18*a* is then, caused to pass through the slot 14 of the corresponding planar side face 3 of the body 10, and is received at its inner end in the corresponding bore 15*a* of the receptacle 15. A head 18*b* is forcibly fitted into the inner end of the hollow stem, and is engaged with the inner face of the receptacle. Therefore, the pivots 18*a* interconnect the lid member 16 with the receptacle 15. As a result, distal ends of the leg portions 17 and 17 are pivotally connected to the receptacle 15 through the pivots 18*a* and 18*a* so that the lid member 16 is pivotally movable about the pivots 18*a*.

The pivots 18 and 18*a* are received respectively in the slots 14 and 14 for sliding movement along the slots 14 The pivots 18*a* and 18*a* have their respective axes in coaxial relation to each other and perpendicular to the planar side faces 13 of the body 10. The inner ends of the pivots 18*a* are fixedly connected to the receptacle 15, while the outer ends of the pivots are rotatably connected respectively to the distal ends of the leg portions 17 and 17.

When the pivots 18*a* and 18*a* are positioned adjacent respectively to the lower ends of the slots 14 and 14, that is, when the receptacle 15 is in its retracted most position, the cosmetic C is fully retracted into the body 10. On the other hand, when the pivots 18*a* and 18*a* are located adjacent respectively to the upper ends of the slots 14 and 14, that is, when the receptacle 15 is in its extended most position as shown in FIG. 6, the cosmetic C is fully projected outward from the open end of the body 10. When the receptacle 15 is in a position between its extended and retracted most positions, each pivot 18*a* is in resilient engagement with one of the projecting members 14*a* of the body 10. Therefore, the receptacle can be retained at any desired position between its extended and retracted most positions. When the lid member 16 is in its closed position as shown in FIG. 5, the head portion 16*a* of the lid member 16 closes the open end of the body 10, and the inner faces of the leg portions 17 and 17 are mated respectively with the planar side faces 13 and 13 of the body 10.

Figure 4:
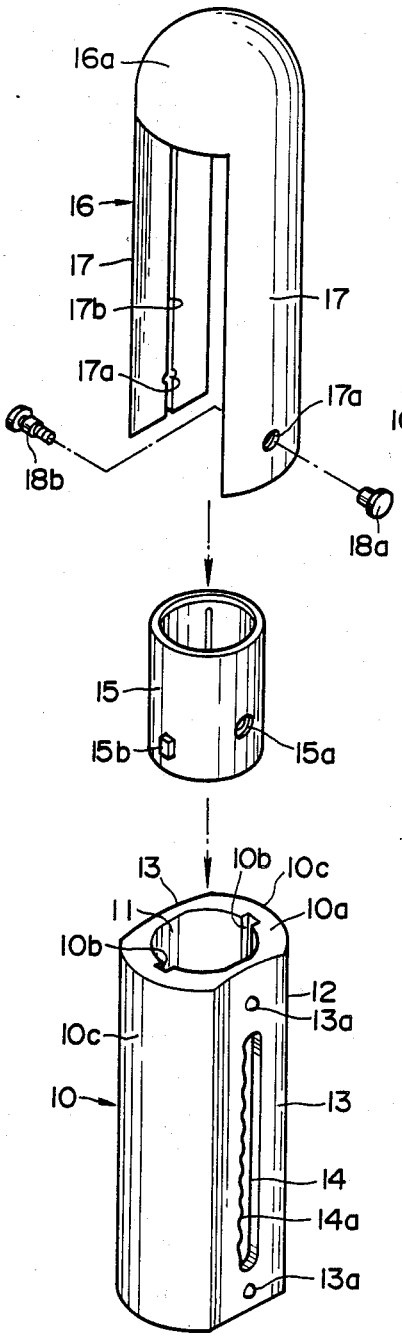
FIG. 4 is an exploded perspective view of a cosmetic case according to the present invention.

As best shown in FIG. 4, those portions of the outer face of the body 10, which extend between the planar faces 13 and 13, are formed into curved faces 10*c* and 10*c*. These curved faces 10*c* and 10*c* are convexly curved when they are viewed from a plane perpendicular to the longitudinal axis of the body 10. The semispherical outer face of the head portion 16*a* of the lid member 16 is smoothly continuous to the curved outer faces of the respective leg portions 17 and 17 of the lid member 16. When the lid member 16 is in its closed position, the curved outer faces of the leg portions 17 and 17 are smoothly continuous to the curved faces 10*c* and 10*c* of the body 10, and the semispherical face of the head portion 16*a* is also smoothly continuous to the curved faces 10*c* and 10*c* of the body 10. Accordingly, when the lid member 16 is in its closed position, the curved outer faces of the leg portions 17 and 17 cooperate with the curved faces 10*c* and 10*c* of the body 10 to form a generally cylindrical outer peripheral face of the case. Needless to say, the curved outer faces of the leg portions 17 and 17 may cooperate with the curved faces 10*c* and 10*c* of the body 10 to form a outer peripheral face of the case having a generally elliptic cross section.

The lengths of the respective leg portions 17 and 17 are such that the head portion 16*a* of the lid member 16 closes the open end of the body 10 when the receptacle 15 is in its retracted most position. In order to enable the lid member 16 to pivot about the axes of the pivots 18*a* from its closed position, the open end face 10*a* of the body 10 is convexly curved when it is viewed from a plane parallel to the planar faces 13 and 13. The inner face 16*b* of the head portion 16*a* is concavely curved at a generally equal curvature to the curvature of the open end face 10*a* of the body 10 so that the inner face 16*b* is matable with the open end face 10*a* of the body 10. The curvatures of both the open end face 10*a* and the inner face 16*b* are determined on the basis of the overall size and configuration of the case and the range of the receptacle's sliding movement. In FIGS. 4 to 9, the open end face 10*a* of the body has a radius of curvature of which center is located generally at the lower end portion of each inner peripheral wall defining the slot 14.

Figure 5:
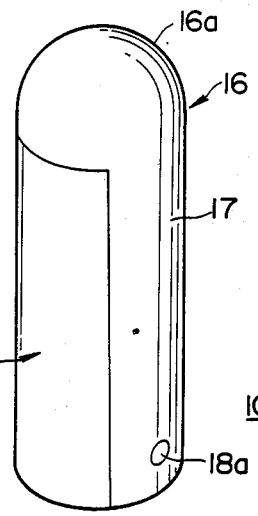
FIG. 5 is a perspective view of the case in FIG. 4, showing a lid member in its closed position.
Figure 6:
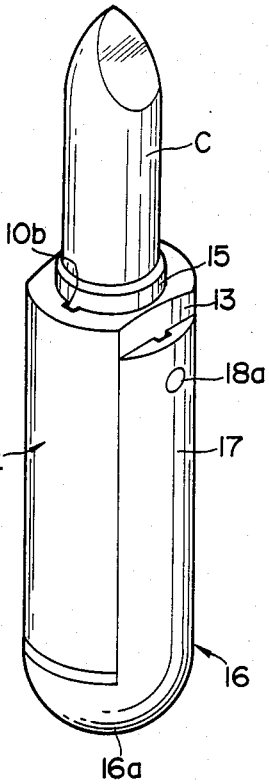
FIG. 6 is a perspective view of the case in FIG. 4, showing a stick-type cosmetic fully projecting outward from a case body.

When the lid member 16 is in its closed position as shown in FIG. 5, the receptacle 15 is in its retracted most position, and the projections 13*a* and 13*a* on each of the planar faces 13 are resiliently engaged with the guide groove 17*b* of the corresponding leg portion 17. The engagement between the projections 13*a* and the guide groove 17*b* help the lid member 16 in moving straight to its opened position shown in FIG. 9, directly above its closed position.

Figure 7:
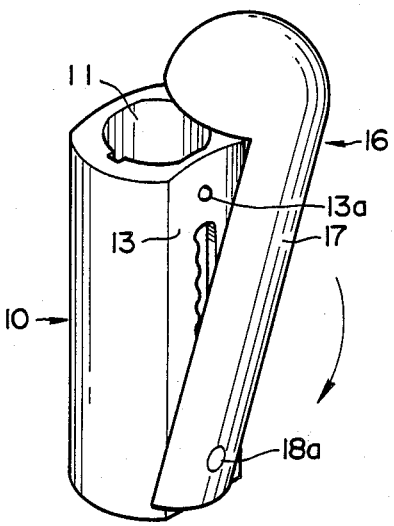
FIG. 7 is a perspective view of the case in FIG. 4, showing the lid member pivoted sideward from its closed position.
Figure 8:
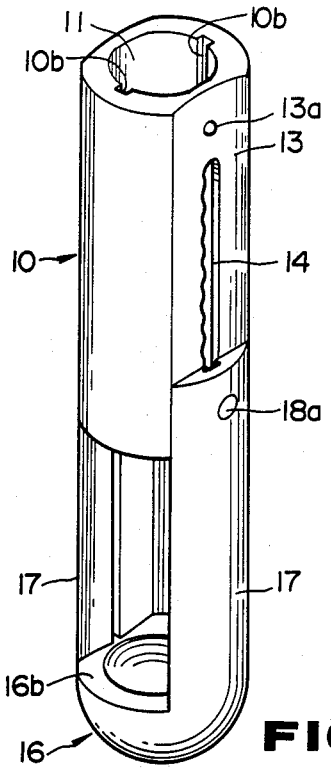
FIG. 8 is a perspective view of the case in FIG. 4, showing the lid member pivoted to a position in which the head portion of the lid member confronts the closed end face of the case body.
Figure 9:
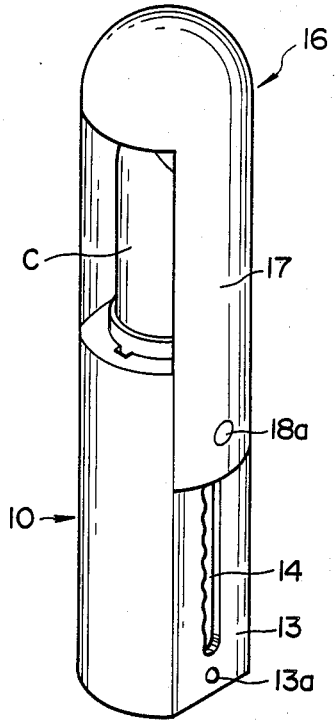
FIG. 9 is a perspective view of the case in FIG. 4, showing the lid member pulled up straight from its closed position along the axis of the case body.

When it is necessary to use the cosmetic C, the lid member 16 is pivoted sideward from its closed position as shown in FIG. 7, and thereby the guide grooves 17*b* and 17*b* are disengaged from the projections 13*a* and 13*a*. Then, as shown in FIG. 8, the lid member 16 is pivoted approximately 180° to a position in which the inner face 16*b* of the head portion 16*a* confronts the closed end face of the body 10. The lid member 16 is then pushed up so that the inner face 16*b* moves straight toward the closed end face of the body 10. During this straight movement of the lid member 16, the pivots 18*a* successively clear the projecting members 14*a*. When the receptacle 15 reaches its extended most position, the cosmetic C fully projects outward from the body 10 as shown in FIG. 6. Upon the projection of the cosmetic C, the pivots 18a engage respectively with the uppermost projecting members 14a and 14a, resulting in the receptacle being retained in its extended most position. Accordingly, it is possible to prevent the fully extended cosmetic C from being unintentionally retracted into the body 10. Alternative way of causing the cosmetic C to project from the body is as follows. The lid member 16 is pulled upward from its closed position so that the inner face 16b of the lid member 16 moves straight away from the open end face 10a of the body 10. In this case, the lid member 16 is pivoted toward a position shown in FIG. 6 after the receptacle 15 is brought to its extended most position.

Figure 10:
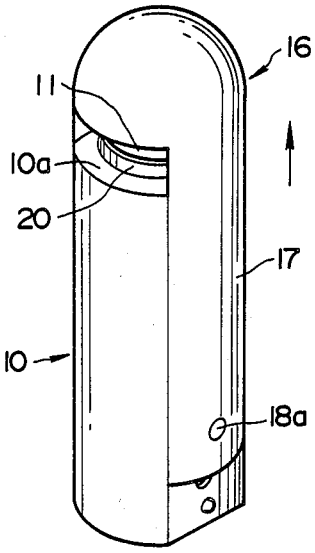
FIG. 10 is a perspective view of another embodiment of the present invention, showing a lid member slightly pulled up from its closed position.
Figure 11:
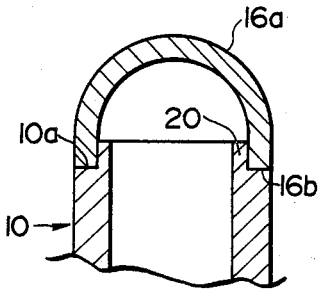
FIG. 11 is a fragmentary axial-sectional view of the case in FIG. 10.

FIGS. 10 and 11 illustrate another embodiment of the present invention, in which an annular engaging member 20 is formed on the open end face 10a of the body 10 in such a manner that the annular member 20 surrounds the opening at the open end face of the body 10. When the lid member 16 is in its closed position, the annular member 20 is engaged with the inner peripheral face of the head member 16a as shown in FIG. 11, and therefore the lid member 16 is prevented from being unintentionally pivoted sideward from its closed position. When the lid member 16 is slightly pulled upward to a position in which the inner peripheral face of the head portion 16a is disengaged from the annular member 20, the lid member 16 is pivotally movable about the axes of the pivots 18a. The cosmetic case of this embodiment has an advantage that the open end face 10a of the body 10 and the inner face 16b of the head portion 16a are not necessarily curved, but are planar.

Figure 12:
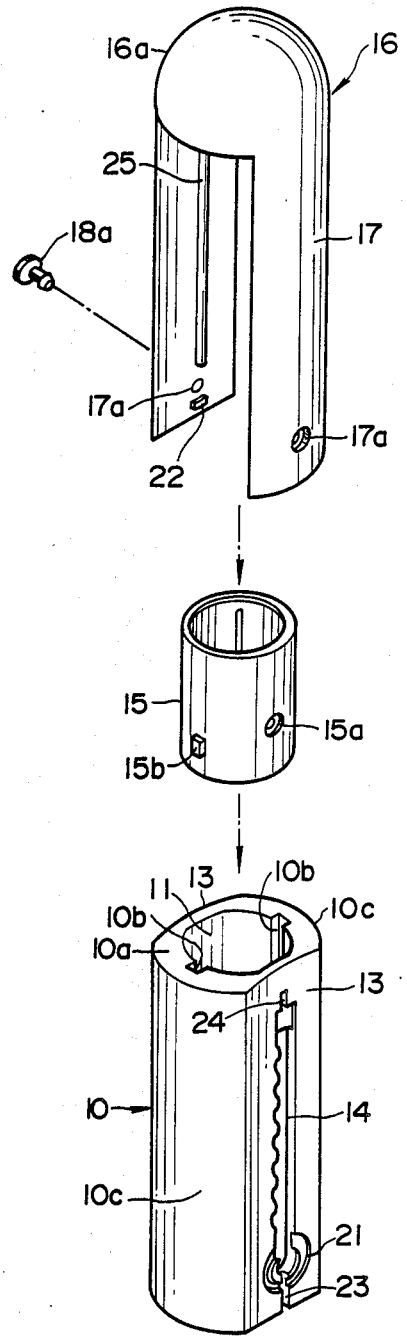
FIG. 12 is an exploded perspective view of still another embodiment of the present invention.
Figure 13:
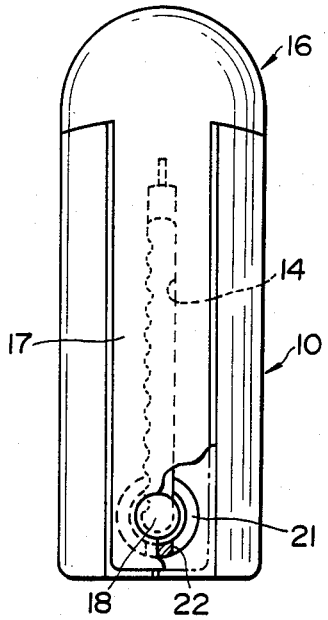
FIG. 13 is a side-elevational view, partly cut away, of the case in FIG. 12, showing a lid member in its closed position.
Figure 14:
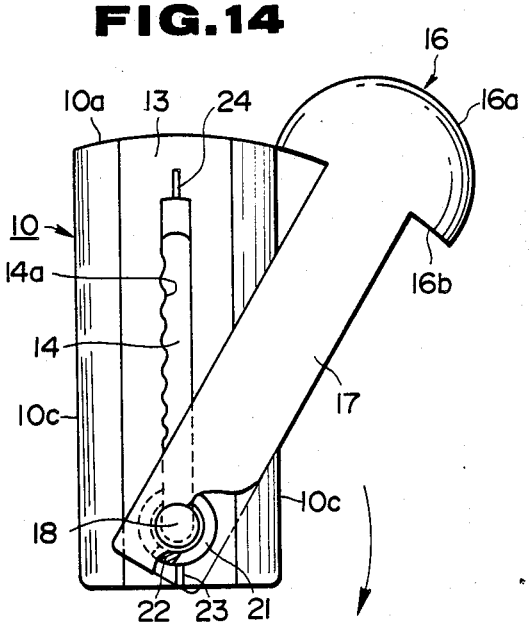
FIG. 14 is a side-elevational view, partly cut away, of the case in FIG. 12, showing the lid member pivoted sideward from its closed position.

FIGS. 12 to 14 show still another embodiment of the present invention. As best shown in FIG. 12, a pair of substantially annular grooves 21 and 21 (only one shown in FIG. 12) are formed respectively in the planar faces 13 and 13. The annular grooves 21 are located adjacent to the closed end of the body in such a manner that the grooves 21 surround the lower end portions of the slots 14 respectively. Each annular guide groove 21 intersects the corresponding slot 14 so that it overlaps and communicates with the corresponding slot 14. The lid member 16 has a pair of arcuate projections 22 and 22 (only one shown in FIG. 12) formed respectively on the inner faces of the leg portions 17 and 17. The distance between the arcuate projection 22 of the corresponding leg portion 17 and the center of the bore 17a of the same leg portion 17 is equal to the inner radius of each annular guide groove. When the receptacle 15 is in its retracted most position as shown in FIG. 13, the arcuate projections 22 are received respectively in the annular guide grooves 21 for sliding movement therealong. Because of this engagement between the arcuate projections 22 and the annular guide grooves 21, an accidental upward sliding movement of the lid member 16 from its closed position is prevented. Furthermore, upper and lower engaging grooves 24 and 23 is formed in each of the planar faces 13 and 13. The upper engaging groove 24 is disposed at the upper hand side of the corresponding slot 14 so that the centerline of the upper engaging groove 24 is coincidental with the centerline of the corresponding through slot 14. The lower end of the upper engaging groove 24 is in communication with the corresponding slot 14. The lower engaging groove 23 is disposed at the lower hand side of the corresponding slot 14 in such a manner that the centerline of the lower engaging groove 24 is coincidental with the centerline of the upper engaging groove 24. The lower engaging groove 23 intersects the corresponding annular guide groove 21, thus overlapping and communicating with the corresponding annular guide groove 21. Furthermore, the upper end of the lower engaging groove 23 is in communication with the corresponding slot 14. An engaging ridge 25 is formed on the inner face of each leg portion 17 of the lid member 16 so as to extend from the proximal end of the corresponding leg portion to a position adjacent to the bore 17a of the corresponding leg portion 17. That is, when the lid member 16 is in its closed position, the upper and lower end portions of each engaging ridge 25 fit respectively in the upper and lower engaging groove 24 and 23 of the corresponding planar face 13, and the intermediate portion of the ridge 25 is received in the corresponding slot 14. In addition, each of pivots 18a in this embodiment has a head portion and a stem. The stem of the pivot 18a is provided at its inner end with a engaging portion of a larger diameter than the diameter of the rest of the stem. Accordingly, by forcibly inserting the pivots 18a into the bores 17a and 15a, the engaging portions of the pivots 18a prevent the pivots 18a from becoming withdrawn from the bores 17a and 15a.

In order to use the cosmetic C, the lid member 16 is pivoted sideward from its closed position as shown in FIG. 14, and thereby the engaging ridges 25 are disengaged from the upper and lower engaging grooves 24 and 23. Subsequently, the lid member 16 is pivoted to a position in which the inner face of the head portion 16a faces the closed end face of the body 10. In this state, the engaging ridges 25 are again in engagement respectively with the lower engaging grooves 23, and the arcuate projections 22 are located respectively at that portions of the annular guide grooves 21 overlapping the through slots 14, thereby being allowed to enter and slide upward along the slots 14. Then, under the guidance of the lower engaging groove 23, the lid member 16 is moved straight upward until the receptacle 15 is brought to its extended most position, causing the cosmetic C to project outward from the body 10.

As described above, the curved outer faces of the leg portions 17 smoothly meet the curved faces of the body 10 when the lid member 16 is in its closed position. For this reason, it is possible to avoid such an inconvenience that, when the cosmetic case is carried in a pocketbook, the carrier's fingers or articles in the pocketbook are caught on the leg portions of the lid member. Therefor, in the cosmetic case of the present invention, the stick-type cosmetic is not likely to accidentally project outward from the case body.

Although in the foregoing embodiments, the two guide grooves 10b are provided in the body 10, it should be readily apparent that only one guide groove 10b may be replaced with the two grooves.

What is claimed is:

1. A case for containing a stick-type cosmetic, said case comprising:

a substantially tubular case body having an open end and a closed end, the body having parallel planar opposite side faces constituting a part of the outer peripheral face of the body, the planar side faces extending between the open and closed ends of the body, each of the planar side faces having a through slot extending along the longitudinal axis of the body, the through slot communicating with the internal space of the body;

a receptacle member for fixedly receiving one of the opposite ends of the stick-type cosmetic, the receptacle member being slidably received in the tubular case body for axial movement between first and second positions, the first position being such that the cosmetic fully projects outward from the open end of the body when the receptacle member is in the first position, the second position being such that the cosmetic is fully retracted into the body when the receptacle member is in the second position;

a pair of coaxial pivots connected to the receptacle member is such a manner that the axes of the pivots are perpendicular to the planar side faces of the body, the pivots being received respectively in the through slots of the body for sliding movement along the slots;

a generally U-shaped lid member having a head portion and a pair of spaced parallel leg portions, each of the leg portions having proximal and distal ends and outer and inner opposite faces, the proximal ends of the leg portions being integrally connected to the head portion, the distal ends of the leg portions being pivotally connected to the receptacle member through the pivots so that the lid member is pivotally movable about the axes of the pivots, the inner faces of the leg portions being substantially planar, the lid member being movable to a closed position, the closed position being such that when the lid member is in the closed position, the head portion of the lid member closes the open end of the body, and the entire inner faces of the leg portions are mated respectively with the entire planar side faces of the body, said outer peripheral face of the body including a pair of front and rear curved faces, each extending between the planar side faces of the body, the front and rear curved faces being convexly curved when the curved faces are viewed from a plane perpendicular to the longitudinal axis of the body, and wherein the outer faces of the leg portions are convexly curved when the outer faces of the leg portions are viewed from a plane perpendicular to the longitudinal axes of the leg portions, the outer faces of the leg portions being smoothly continuous to the front and rear curved faces of the body when the lid member is in its closed position, said outer faces of the leg portions cooperating with the front and rear curved faces of the body to form a substantially cylindrical outer peripheral face of the case when the lid member is in its closed position, said head portion of the lid member being of a dome-like configuration having a semispherical outer face, the semispherical outer face being smoothly continuous to the outer faces of the leg portions, the semispherical outer face being smoothly continuous to the front and rear curved faces of the body when the lid member is in its closed position, each of the planar side faces of the body having a first engaging means, and wherein the inner face of each of the leg portions has a second engaging means, the second engaging means being resiliently engaged with the first engaging means when the lid member is pivoted to a position in which the longitudinal axes of the leg portions are parallel to the longitudinal axis of the case body, the first engaging means comprising a pair of inner walls defining respective first and second grooves in the corresponding planar side face of the body, the first groove being disposed on a line coincidental with the centerline of the through slot at a position between the open end of the body and the corresponding slot, the first groove communicating with the corresponding through slot, the second groove being disposed on a line coincidental with the centerline of the corresponding through slot at a position between the closed end of the body and the corresponding through slot, the second groove communicating with the corresponding through slot, and wherein the second engaging means comprises a ridge formed on the inner face of the corresponding leg portion, the ridge extending along the longitudinal axis of the corresponding leg portion, the case body having a pair of inner peripheral walls, each defining the through slot, each of the inner peripheral walls comprising first and second opposite end portions and a pair of opposed and elongated side portions, the first end portion being disposed adjacent to the open end of the body, the second end portion being disposed adjacent to the closed end of the body, wherein each of the planar side faces of the body has an annular guide groove surrounding the second end portion of the corresponding inner peripheral wall, the annular guide groove intersecting both the corresponding through slot and the corresponding second groove so that the guide groove overlaps and communicates with both the corresponding through slot and the corresponding second groove, and wherein the inner face of each of the leg portions has an arcuate projection disposed adjacent to the distal end of the corresponding leg portion, the arcuate projection being slidably received in the corresponding annular guide groove when the receptacle is in its second position, for sliding movement along the annular guide groove.

2. In a case for containing a stick-type cosmetic, the case including:

a substantially tubular case body having an open end and a closed end, the body having parallel planar opposite side faces constituting a part of the outer peripheral face of the body, the planar side faces extending between the open and closed ends of the body, each of the planar side faces having a through slot extending along the longitudinal axis of the body, the through slot communicating with the internal space of the body;

a receptacle member for fixedly receiving one of the opposite ends of the stick-type cosmetic, the receptacle member being slidably received in the tubular case body for axial movement between first and second positions, the first position being such that the cosmetic fully projects outward from the open end of the body when the receptacle member is in the first position, the second position being such that the cosmetic is fully retracted into the body when the receptacle member is in the second position;

a pair of coaxial pivots connected to the receptacle member is such a manner that the axes of the pivots are perpendicular to the planar side faces of the body, the pivots being received respectively in the through slots of the body for sliding movement along the slots; and generally U-shaped lid member having a head portion and a pair of spaced parallel leg portions, each of the leg portions having proximal and distal ends and outer and inner opposite faces, the proximal ends of the leg portions being integrally connected to the head portion, the distal ends of the leg portions being pivotally connected to the receptacle member through the pivots so that the lid member is pivotally movable about the axes of the pivots, the inner faces of the leg portions being substantially planar, the lid member being movable to a closed position, the closed position being such that when the lid member is in the closed position, the head portion of the lid member closes the open end of the body with the receptacle member being in the second position and the entire inner faces of the leg portions are mated respectively with the entire planar side faces of the body, the improvement wherein the case body has a pair of inner peripheral walls, each defining the through slot, each of the inner peripheral walls comprising first and second opposite end portions and a pair of opposed and elongated side portions, the first end portion being disposed adjacent to the open end of the body, the second end portion being disposed adjacent to the closed end of the body, wherein each of the planar side faces of the body has an annular guide groove surrounding the second end portion of the corresponding inner peripheral wall, the annular guide groove intersecting the corresponding through slot so that the guide groove overlaps and communicates with the corresponding through slot, and wherein the inner face of each of the leg portions has an arcuate projection disposed adjacent to the distal end of the corresponding leg portion, the arcuate projection being slidably received in the corresponding annular guide groove for sliding movement along the annular guide groove when the receptacle is in its second position and being slidably received in the corresponding through slot for sliding movement along the through slot when the arcuate projection is brought into the through slot.

3. A case according to claim 2, wherein each of the planar side faces of the body has a first engaging means, and wherein the inner face of each of the leg portions has a second engaging means, the second engaging means being resiliently engaged with the first engaging means when the lid member is pivoted to a position in which the longitudinal axes of the leg portions are parallel to the longitudinal axis of the case body.

4. A case according to claim 3, wherein the first engaging means comprises a pair of projections formed on the corresponding planar side face of the body so as to be aligned along the longitudinal axis of the body, one of the projections being disposed between the open end of the body and the corresponding through slot, the other projection being disposed between the closed end of the body and the corresponding through slot, and wherein the second engaging means comprises an inner wall defining a groove in the inner face of the corresponding leg portion, the groove extending along the longitudinal axis of the corresponding leg portion.

5. A case according to claim 4, wherein the open end face of the case body has an annular engaging member surrounding the opening at the open end face of the body, the annular engaging member being releasably engaged with the head portion of the lid member when the lid member is in its closed position.

6. A case according to claim 3, wherein the first engaging means comprises a pair of inner walls defining respective first and second grooves in the corresponding planar side face of the body, the first groove being disposed on a line coincidental with the centerline of the through slot at a position between the open end of the body and the corresponding slot, the first groove communicating with the corresponding through slot, the second groove being disposed on a line coincidental with the centerline of the corresponding through slot at a position between the closed end of the body and the corresponding through slot, the second groove communicating with the corresponding through slot and intersecting the annular guide groove of the corresponding planar side face, and wherein the second engaging means comprises a ridge formed on the inner face of the corresponding leg portion, the ridge extending along the longitudinal axis of the corresponding leg portion.

7. A case according to claim 6 or 1, wherein one of the opposed side portions of each of the inner peripheral walls has a plurality of projecting members aligned along the longitudinal axis of the body, each of the projecting members being engageable with the corresponding pivot.

8. A case according to claim 6, wherein the outer peripheral face of the body includes a pair of front and rear curved faces, each extending between the planar side faces of the body, the front and rear curved faces being convexly curved when the curved faces are viewed from a plane perpendicular to the longitudinal axis of the body, and wherein the outer faces of the leg portions are convexly curved when the outer faces of the leg portions are viewed from a plane perpendicular to the longitudinal axes of the leg portions, the outer faces of the leg portions being smoothly continuous to the front and rear curved faces of the body when the lid member is in its closed position.

9. A case according to claim 8, wherein the outer faces of the leg portions cooperate with the front and rear curved faces of the body to form a substantially cylindrical outer peripheral face of the case when the lid member is in its closed position.

10. A case according to claim 9 or 1, wherein the case has a circular cross section when the lid member is in its closed position.

11. A case according to claim 9, wherein the head portion of the lid member is of a dome-like configuration having a semispherical outer face, the semispherical outer face being smoothly continuous to the outer faces of the leg portions, the semispherical outer face being smoothly continuous to the front and rear curved faces of the body when the lid member is in its closed position.

* * * * *